United States Patent [19]

Hawthorne

[11] Patent Number: 5,028,201

[45] Date of Patent: Jul. 2, 1991

[54] TRANSPORT OF MATERIALS WITH CONTROLLED LOWERING BEFORE UPSET

[76] Inventor: William C. Hawthorne, 1 Lincoln Pl. (Apt. 16G), North Brunswick, N.J. 08902

[21] Appl. No.: 935,975

[22] Filed: Nov. 26, 1986

Related U.S. Application Data

[63] Continuation of Ser. No. 511,958, Jul. 8, 1983, abandoned.

[51] Int. Cl.[5] ..... B65G 59/02

[52] U.S. Cl. ..... 414/796; 414/788.5; 414/796.8; 414/796.2; 414/796.4; 414/759; 414/774

[58] Field of Search ..... 414/759, 760, 774, 786, 414/788.4, 788.5, 791.3, 798.3, 798.6, 798.5, 796, 796.1, 796.8, 796.2, 796.4; 271/115, 128, 130, 142

[56] References Cited

U.S. PATENT DOCUMENTS

| | | | |
|---|---|---|---|
| 1,694,586 | 12/1928 | Dyhrberg | 414/106 X |
| 3,176,859 | 4/1965 | Prager | 414/114 |
| 3,206,042 | 9/1965 | Peterson | 414/114 |
| 3,447,696 | 6/1969 | Calistrat | 414/55 X |
| 3,541,597 | 11/1970 | Segawa et al. | 414/106 |
| 3,655,072 | 4/1972 | Bateman | 414/788.5 |
| 3,908,836 | 9/1975 | Ikeda | 414/114 X |
| 3,915,318 | 10/1975 | Cook et al. | 414/796.2 |
| 3,967,739 | 7/1976 | Kumagai | 414/788.5 |
| 4,349,304 | 9/1982 | Ogawa et al. | 414/106 |
| 4,457,658 | 7/1984 | Meylan | 414/114 |

FOREIGN PATENT DOCUMENTS

| | | | |
|---|---|---|---|
| 1013156 | 8/1957 | Fed. Rep. of Germany | 414/32 |
| 2313294 | 12/1976 | France | 414/114 |

*Primary Examiner*—Robert J. Spar
*Assistant Examiner*—William M. Hienz
*Attorney, Agent, or Firm*—George E. Kersey

[57] ABSTRACT

Apparatus for the transport of materials by elevating a stack of materials, moving a selected group of the materials and controllably lowering the materials to an upset position, from which the group is moved simultaneously to an output position.

3 Claims, 5 Drawing Sheets

TRANSPORT OF MATERIALS WITH CONTROLLED LOWERING BEFORE UPSET

This is a continuation of Ser. No. 06/511,958 filed July 8, 1983, now abandoned.

BACKGROUND OF THE INVENTION

This invention relates to the transport of materials, and, more particularly, to the automatic transport of sheet materials.

It is often necessary to move materials from one position to another. For example, corrugated or cardboard sheets, often in stacks, are moved from a receiving position and loaded into a hopper and fed to a press where they are imprinted with a desired legend.

Although the stacks can be transported manually from their receiving position and manually loaded into the hopper, it is desirable to automate the loading For that purpose a number of arrangements have been proposed. Representative examples are U.S. Pat. No. 3,422,969 which issued to J. A. Miller et al. in January 1969; U.S. Pat. No. 3,643,939 which issued to H. A. Nussbaum, et al. in February 1972; and U.S. Pat. No. 4,119,219 which issued to Carl R. Marschke on Oct. 10, 1978.

Other arrangements are disclosed in Welk U.S. Pat. No. 2,318,132 which issued May 1943; Krinke U.S. Pat. No. 3,262,697 which issued July 1966; Parenti, et al. U.S. Pat. No. 3,860,234 which issued January 1975; and Krebs U.S. Pat. No. 3,885,781 which issued May, 1975.

Still other patents relating to the transport of material are Smith U.S. Pat. No. 1,141,277 which issued June 1915; Palmer U.S. Pat. No. 2,553,719 which issued May 1951; Lundall U.S. Pat. No. 2,778,477 which issued January 1957; Parker U.S. Pat. No. 2,829,759 which issued April 1958; Martin U.S. Pat. No. 2,901,250 which issued August 1959; Gerrans U.S. Pat. No. 2,966,253 which issued December 1960; Letchworth U.S. Pat. No. 3,297,174 which issued January 1967; Thull U.S. Pat. No. 3,464,537 which Issued September 1969; Marschke et al. U.S. Pat. No. 3,724,687 which issued April 1973; Hoke et al., U.S. Pat. No. 4,079,644 which issued Mar. 21, 1978; Marschke U.S. Pat. No. 4,200,276 which issued Apr. 29, 1980, Marschke U.S. Pat. No. 4,235,432 which issued Nov. 25, 1980; and Rodewald U.S. Pat. No. 4,273,325 which issued June 16, 1981.

The foregoing and other prior art transport systems have a number of disadvantages. In general they are characterised by significant complexity and insufficient reliability. In addition, if there is a mechanical or other failure which requires a temporary shutdown for repair, the interposition of the transport system between a receiving or input station and an output location interferes with the continued use of the output equipment.

In the case of U.S. Pat. No. 3,422,963, a stack that is to be transported to an output location is upset on an incline where the weight of the sheets against one another can interfere with the desired output feed. In addition, the upset is achieved by the tilting of slats which form a backrest and which have to be lowered sufficiently to reduce the weight of the upper sheets of the stack against the lower sheets. As a result, there is an inadequate gravitational effect for the proper feed of the upper sheets along the slats. The system further employs an output conveyor which has a greater angle of inclination than the inclined conveyor that feeds sheets to it. This change in angle of inclination produces a further impediment to the proper feed of sheets. The impact of oncoming sheets can produce so much pressure against the sheets on the incline that jamming can result, In U.S. Pat. No. 3,643,939 it is necessary to employ a transfer conveyor that requires rotation with a full load through an angle greater than 90 degrees. The result is a system of significant electrical and mechanical complexity.

In U.S. Pat. No. 4,119,219, the edges of the upper portion of a stack of sheets are driven into a rotating roll which raises the edges in succession and then forms a lip with a second roll for the feed of a batch of sheets. If the edges are not raised in succession, or if the two rolls are not moved properly, jamming can result.

Transport systems which do not prevent through-flow of materials when there is a temporary shutdown are disclosed in Pulda U.S. Pat. Nos. 3,982,750 which issued Sept. 28, 1976 and 4,008,890 which issued Feb. 22, 1977. They, however, have a substantial spacial requirement.

Accordingly, it is an object of the invention to facilitate the automatic transport of materials from an input position to an output position. A related object is to facilitate the transport of sheet materials.

Another object of the invention is to provide a comparatively compact transport system which will not prevent the through-flow of materials when the system is temporarily shut down, for example, for repair.

Still another object of the invention is to speed the transport of materials. A related object is to eliminate the need for shingling in the transport of sheet materials. Another related object is to achieve batch feeding of materials with reduced chance of jamming.

Yet another object of the invention is to facilitate the upset of stacks of large and heavy sheets of material. A related object is to permit the selective reorientation of batches of material.

A still further object of the invention is to control the throughput of a transport system to insure a continuous and adequate supply of material at the system output.

SUMMARY OF THE INVENTION

In accomplishing the foregoing and related objects, the invention provides for the transport of materials by elevating a stack of the materials and then transporting a group of the materials in the elevated stack to an upset position. From the upset position the materials of the group are simultaneously transported to an output, such as a hopper of a printing press.

In accordance with one aspect of the invention, the materials are upset at the upset position, either by being reoriented so that portions of the materials that formerly faced downwardly now face upwardly, or by changing the way in which the materials are supported. In the case of sheet materials, a grouping forming a partial stack supported with a lower face upwardly can be upset in the sense of being thereafter supported not only with respect to the lower faces which are stacked upon one another, but also with respect to the edges of the stack of materials.

In accordance with another aspect of the invention, the materials are elevated against a movable backstop. This assures that the materials which are selected to form a group at the first transport location will not become disarranged and interfere with subsequent feeding of the materials. The backstop can be positioned below the level at which the group is transported from the elevated position, or above the level at which the group is transported from the elevated position.

In accordance with a further aspect of the invention, the group is separated from the stack prior to being transported to the upset position. The separation is advantageously effected by the use of a peel-off finger. The extent of the group is desirably determined by a pivotal separating plate which controls the height to which the stack can be elevated.

In accordance with a still further aspect of the invention, the position of the peel-off finger with respect to the stack is pivotally adjustable. The upset position can include an inclined support surface which is also pivotal. The latter controls the noise and impact that are made by the group of materials at the upset position.

In accordance with yet another aspect of the invention, the materials of the group are aligned against an inclined support surface at an upset position. The alignment is accomplished by plates which move along the inclined support surface. The alignment plates are desirably coordinated in their motions to move towards one another in effecting the desired alignment of the materials, for example, sheets of paper in a stack.

In accordance with still another aspect of the invention, the group of materials that is transported from the upset position is pushed along an outfeed platform. The pusher is desirably pivotally mounted so that on its return stroke it can clear any obstacle in its path.

In accordance with a yet further aspect of the invention, the elevating and transporting of the materials takes place on a roller mounted feed. In addition, scrap materials are desirably feedable transversely from the elevational position. The materials are desirably sheets of paper, for example, corrugated cardboard, which are elevated vertically and are then transported horizontally from their elevated position to the upset position.

DESCRIPTION OF THE DRAWINGS

Other aspects of the invention will become apparent after considering several illustrative embodiments taken in conjunction with the drawings in which.

DETAILED DESCRIPTION

Figure 1:
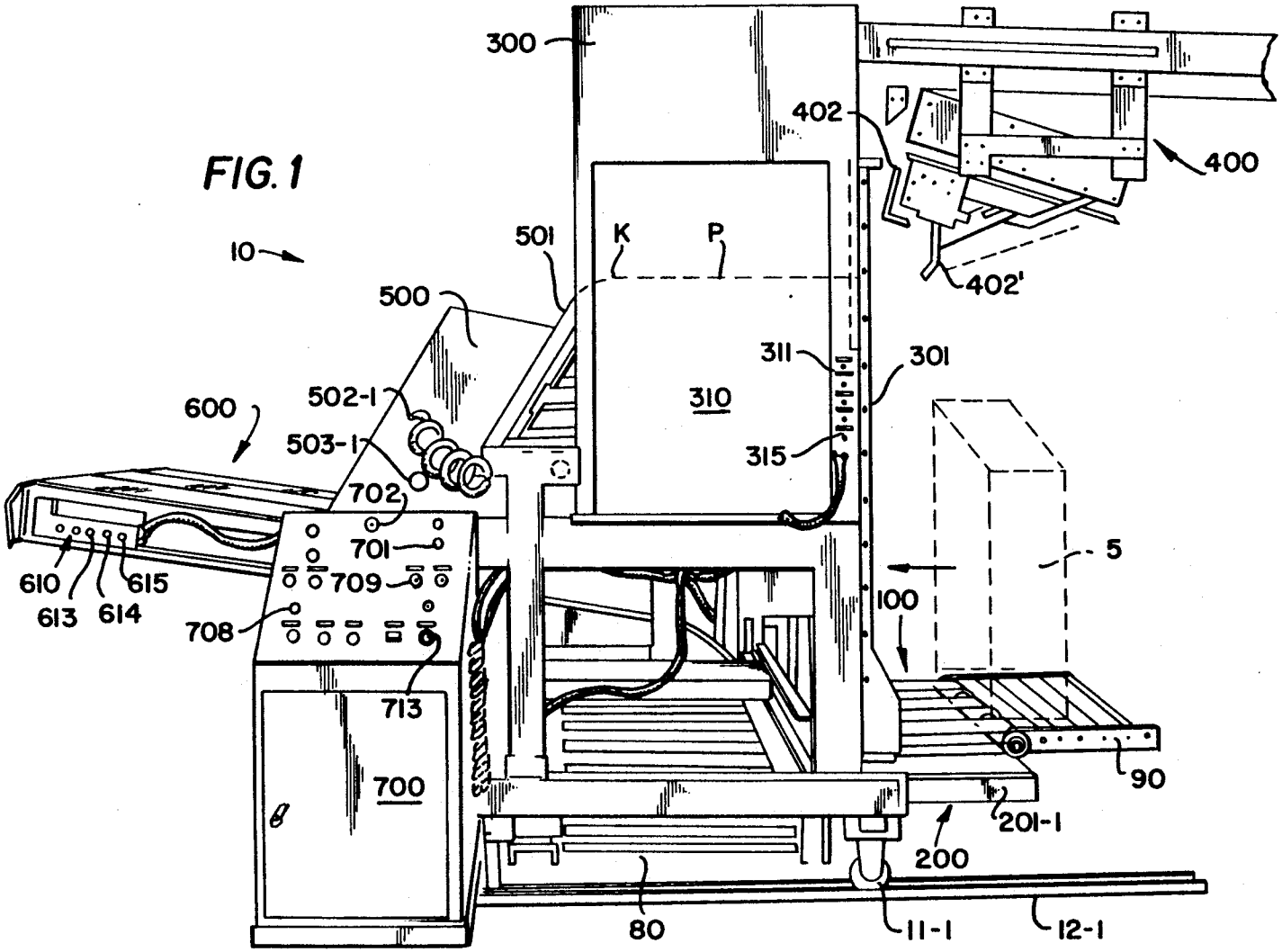
FIG. 1 is a side view of a mechanism for transporting materials in accordance with the invention.

With reference to the drawings, a transport system 10 in accordance with the invention is shown in FIG. 1.

The system 10 is formed by a stack infeed conveyor 100, a stack lift 200, a main frame 300, a separator mechanism 400, an upset support mechanism 500, and an outfeed platform 600. The operation of the transport system 10 is controlled by a separate panel 700. Additional control functions are exercised from a set of switches 310 on the main frame 300.

In general terms the transport system 10 is operated with respect to a stack of materials such as the stack of sheets S shown positioned on the infeed conveyor 100. The stack S is transported to the infeed conveyor 100 in any convenient way, for example from a loading dock over an auxiliary roller conveyor such as the unit 90 which is partially illustrated in FIG. 1.

Once the stack S has been positioned suitably against the backstop 301 of the frame 300, it is elevated vertically along the backstop 301 by lift arms 201-1 and 201-2 of the lift 200. The stack S is raised to a position where the separator 400 can remove a predetermined batch of sheets from the stack S and advance the batch, as a group along the dashed line path P which is within the main frame 300. The mechanism for separating the batch from the stack S and conveying it forwardly along the path P is explained in greater detail below. As the batch of sheets passes beneath the knee K of the path P it falls by gravity along a slide 501 of the support mechanism 500, between side panels 502-1 and 502-2. Only the side panel 502-1 is visible in FIG. 1. It will be seen below that there is a companion side panel 502-2 which moves in coordination with the first side panel 502-1 under the control hydraulic cylinders, of which only the cylinder 503-1 is visible in FIG. 1.

As the stack S is elevated by the lift 200 the sheets constituting the stack are face to face upon one another. The batch which is moved along the interior path P within the main frame 300 also includes a partial stack in which the sheets are face to face upon one another with the lowermost face in contact with the path P. However, once the batch passes the knee point of the path P and moves along the slide it is separated not only along the lower face of the lowermost member, but along the edges of the individual sheets constituting the batch as well. This will be seen more clearly below. At this point the edges lie along the output platform 600, and pusher arms, shown below, move the batch forwardly along the platform 600. The end of the platform 600 desirably includes a hopper (not shown) in which the batch sheets are positioned for continued processing, such as feed to a printer which provides a suitable legend on the faces of the individual sheets constituting the batch.

It will be noted that the entire system 10 is mounted on wheels 11 which can be supported in suitable tracks 12. In FIG. 1 only one of the wheels 11-1 is visible shown positioned in the central groove of a track 12-1.

Because of the roller mounting of the entire mechanism 10, it can be pushed out of position to allow manual loading of the hopper or other receptacle located at the end of the platform 600 in the event that a breakdown takes place in the mechanism 10 which requires repair.

The various functions of the transport mechanism 10 are under the control of the panel 700 which includes various control knobs 701 through 713 for operating the lift 200 either manually or automatically;controlling the pusher (between the guide plates 502-1 and 502-2); controlling the guide plates either collectively or individually, and so forth. In addition, further control switches 311 through 315 are located on the side panel of the main frame 300 near the backstop 301. The latter switches control the conveyor 100 and allow it to be operated either manually or automatically, as well as the components of the backstop 301 which are explained further below.

In addition, the system 10 includes a scrap removal conveyor 80 which propels individual sheets from the stack S that has been positioned on the infeed conveyor 100, in those situations where sheets of the stack, which were out of alignment, have been able to pass through the opening between the lower edge of the backstop and the upper level of the scrap removal conveyor 80. The entry of the individual scrap sheets onto the scrap removal conveyor 80 will be clearer from the further description below.

Figure 2:
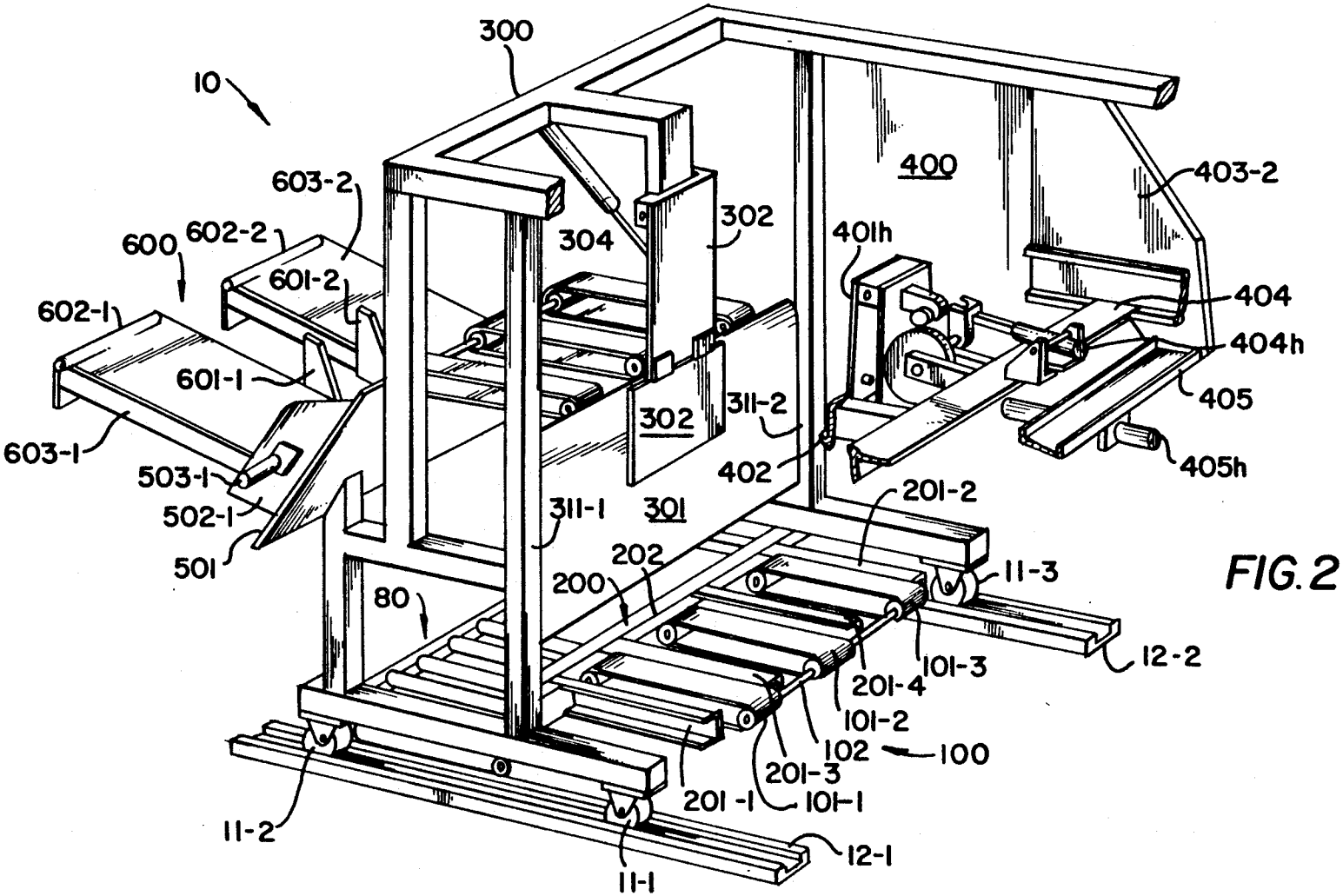
FIG. 2 is a perspective view illustrating various functional components of the mechanism of FIG. 1.

A skeletal outline of the various constituents of the transport system 10 is illustrated in FIG. 2. As can be seen in FIG. 2, the main frame 300 includes girders that support the entire structure on rollers 11-1 through 11-4. The latter ride in tracks of rails 12-1 and 12-2.

As can be seen further in FIG. 2, the lift 200 includes arms 201-1 and 201-2 which straddle the end belts of the infeed conveyor 100. The arms 201-1 and 201-2 are affixed to a transverse member 202 which is vertically elevatable, upon command, between the side girders 311-1 and 311-2 of the main frame 300. The positioning of the support 202 within mounting members 311-1 and 311-2 is conventional.

In the particular embodiment of FIG. 2, the lift 200 includes additional arms 201-3 and 201-4 which are interspersed between individual belts of the infeed conveyor 100. This arrangements permits the elevation and processing of stacks having various longitudinal dimensions. The infeed conveyor 100 includes three belts 101-1 to 101-3. One end of the belts is wrapped around a set of pulleys joined to a common axle 102. The other end of the belts is wrapped around individual pulleys which are supported to allow the interspersion of the fork arms 201-3 and 201-4.

The backstop 301 is elevated above the level of the support arm 202 to allow access to the scrap removal conveyor 80. The latter is operational when individual sheets from the stack, which are out of alignment, enter the scrap removal conveyor as the stack is positioned on the conveyor 100.

Once the stack is suitably located on the conveyor 100 and above the lift 200, it is raised against the backstop 301. Included in the central portion of the backstop is a movable section 302.

The stack is elevated above the edge of the fixed backstop 301 to a position controlled by a sensor (not shown), which is described below. When the stack is in position, that portion is above the upper edge of the fixed backstop 301 and in contact with a front stop 303. The latter is used to assure alignment and non-jamming by that batch portion that will be fed along a bundle conveyor 304 so that the bundle rests against the inclined support 501.

The movement of the bundle onto the conveyor 304 is accomplished by the separator 400 using a peel-off finger 402. The separator 400 is suspended from the frame 300 by side plates, of which only the side plate 403-2 is visible in FIG. 2. Support girders for the peel-off finger 402 and the separator plate 401 extend between the side plates, including the side plate 403-2. In particular, the support girders 404 and 405 mount hydraulic cylinders **404*h* and 405*h* for operating the respective separator plate 401 and the peel-off finger 402**.

Figure 3:
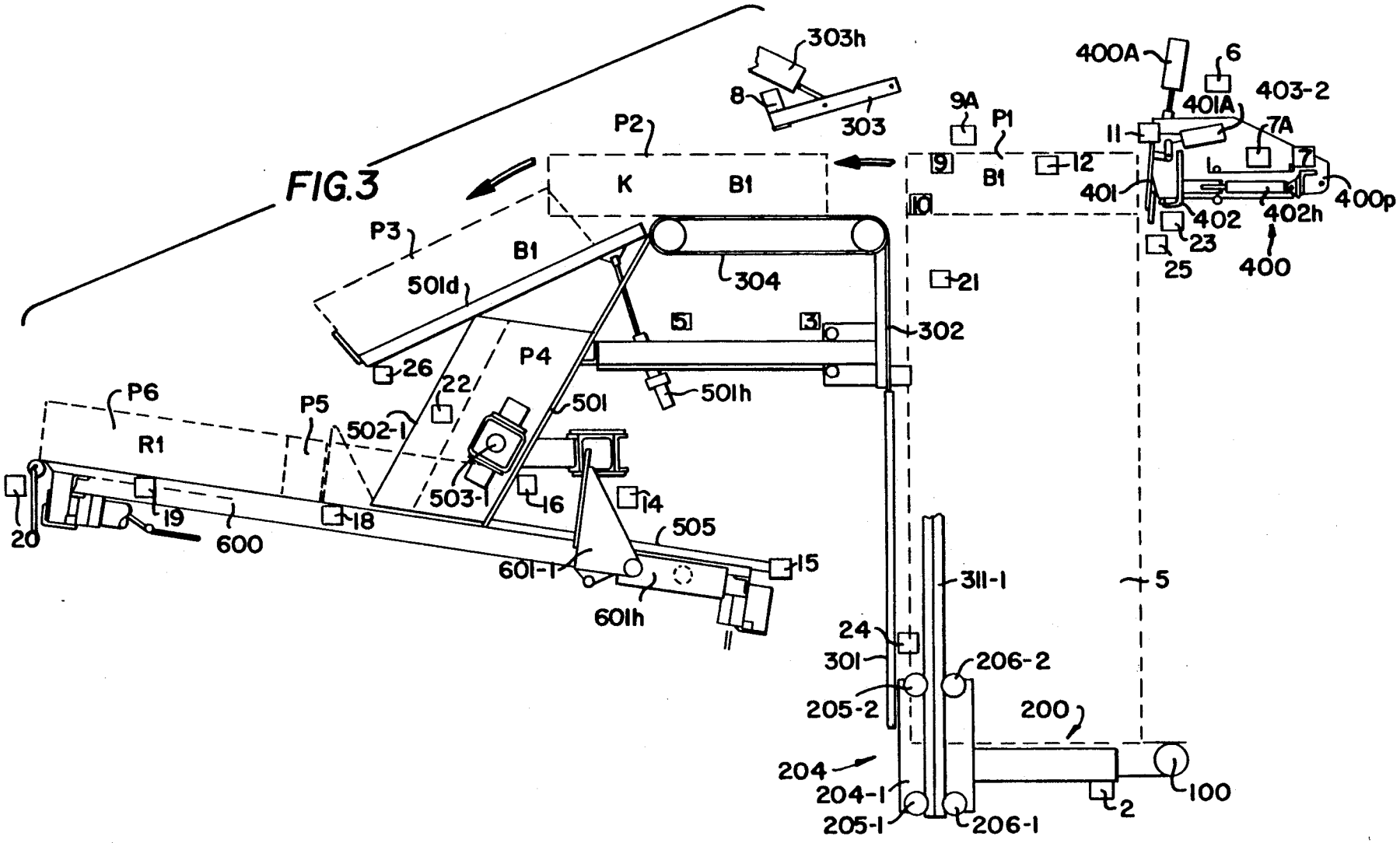
FIG. 3 is a skeletal side view illustrating other functional aspects of the mechanism of FIG. 1.

Once the peel-off finger 402 has been operated to separate a batch of sheets from the elevated stack and move the batch onto the bundle conveyor 304, the bundle moves forwardly until it passes over the frontal pulleys of the conveyor 304 and rests against the inclined support 501 of the upset support mechanism 500. Side panels, of which only the side panel 502-1 is visible in FIG. 2, are operated by respective hydraulic cylinders, including cylinder 503-1, to square the batch or bundle that then rests against the inclined support 501. The bundle is next upset onto the outfeed platform 600, either in the same orientation that existed at the infeed conveyor, or the reverse. For that purpose upset arms are included which are not visible in FIG. 2, but are shown in the embodiment of FIG. 3 below. After the bundle is positioned on the outfeed platform 600, pusher arms 601-1 and 601-2 are used to move the bundle forwardly along the platform 600 until it reaches output rollers 602-1 and 602-2. At that point the bundle moves into a further unit such as the hopper of a press feeder (not shown). It will be appreciated that for the embodiment of FIG. 2 in which the outfeed platform 600 is two separate parts, 603-1 and 603-2, the bundles have a width laterally that exceeds the distance of separation between the two sections 603-1 and 603-2. In some cases, for narrower bundles, a third section can be included between the two sections 603-1 and 603-2 shown in FIG. 2. In addition, the pusher arms 601-1 and 601-2 are depressable below the bundle during retraction, as illustrated in detail below.

The foregoing structural arrangement is explained further with reference to the skeletal view in FIG. 3. In the implementation of FIG. 3, the stack lift 200 is adapted to roll upwardly along side girders, of which only the side girder 311-1 is visible in FIG. 3. For that purpose, the lift 200 includes a roller mounted carriage 204 formed by members 204-1 and 204-2 with respective rollers 205 and 206 that contact opposite sides of the side girder 311-1.

When the incoming stack is applied to the infeed conveyor 100, over the input belts including the belt 101-1 which straddles rollers 103-1 and 103-2, the stack is propelled forwardly until it contacts the fixed backstop 301. As the stack is elevated, it comes into contact with the movable backstop 302 which is operated by a cylinder (not shown) to achieve prepositioning of the stack before operation of the separator 400. Final positioning of the stack with respect to the bundle conveyor 304 is accomplished by the operation of the front stop 303 using a hydraulic cylinder **303*h*. The separator, shown mounted on the right side plate 403-2 is operated with the separating plate 401 fully elevated by a hydraulic cylinder 401*h*, and the peel-off finger 402 is operated by a hydraulic cylinder 402*h*. The separator 400 is also pivotally adjustable by the operation of a hydraulic cylinder 400***h*. As shown in FIG. 3, the latter operation causes the side plate 403-2 (and the companion opposite side plate which is not shown) to move along an arc with respect to a pivot point 400*p*.

The action of the separator causes a bundle or batch of prescribed height to be removed from the stack and moved forwardly onto the bundle conveyor 304. In FIG. 3 the bundle B1, which is separated from the stack S, is shown after having moved onto the bundle conveyor to a position P2 before tumbling at the knee K onto the inclined support 501. In the particular embodiment of FIG. 3, the inclined support 501 includes a drop conveyor 501*d* that is operated by a hydraulic cylinder 501*h*. The purpose of the drop conveyor 501*d* is to lessen the noise impact that can occur when the bundle B passes over the knee K of the bundle conveyor. For that purpose, the drop conveyor can be elevated into alignment with, and even above the top surface of, the bundle conveyor to receive the bundle B at a position P3. When the hydraulic cylinder 501*h* is thereafter retracted, the conveyor 501*d* is lowered into alignment with the inclined support 501 in preparation for bundle upset which next occurs.

In the embodiment of FIG. 3 the upset takes place using arms 505 which are reciprocated in alignment with the surface of the output platform 600 by a hydraulic cylinder (not shown). The upset achieved by the embodiment of FIG. 3 follows the operation of the squaring side panels 502-1 and its opposite member (not visible in FIG. 3). The side panel 502-1 is laterally movable against the face of the inclined support 501 by the hydraulic cylinder 503-1. The bundle B is then in position P4 and it becomes upset when the arms 505 are moved forwardly. As a result, the bundle B occupies the position P5 and is then ready for transport over the output platform to a receiving hopper.

In the embodiment of FIG. 3 the forward movement of the bundle B from the position P5 takes place by a pusher 601. By contrast with the embodiment of FIG. 2, the pusher 601 of FIG. 3 is not depressable below the surface of the outfeed platform 600 and consequently requires retraction through the inclined support 501 before outfeed takes place.

The foregoing operation of the embodiment in FIG. 3 takes place in response to the operation of various sensing devices such as microswitches, strip switches and photoelectric sensors. The various sensors used in FIG. 3 are set forth in the various numbered rectangular boxes as follows:

| SENSOR ID | SENSOR TYPE | SENSOR FUNCTION |
|---|---|---|
| Rect.Blk.2 | Microswitch | Detect fully lowered position of lift 200 |
| Rect.Blk.3 | Microswitch | Detect full extension of movable backstop 302 |
| Rect.Blk.4 | Microswitch | Detect proximity of stack to the face of the movable backstop 302. |
| Rect.Blk.5 | Microswitch | Detect full retraction of the movable backstop 302 |
| Rect.Blk.6 | Magnetic Proximity Switch | Detect fully elevated position of separator 400 |
| Rect.Blk.7 | Magnetic Proximity Switch | Detect full retraction of peel-off finger 401 |
| Rect.Blk.8 | Magnetic Proximity Switch | Detect full elevation of front stop 303 |
| Rect.Blk.9 | Photocell | Detect elevation of stack S to peel-off position where bundle B is separated from the stack before being moved to the bundle conveyor |
| Rect.Blk.9A | Microswitch | Safety load detector to prevent formation of excessively large bundles |
| Rect.Blk.10 | Photocell | Detects fully down position of front stop 303 for permitting the bundle B to be separate from the stack S in the proper position prior to movement onto the bundle conveyor 304 |
| Rect.Blk.11 | Microswitch | Detects full elevation of separator plate 402 |
| Rect.Blk.12 | Photocell | Detects full extension of the peel-off finger 401 against the bundle B separated from the stack S. |
| Rect.Blk.13 | Photocell | Detects position of trailing edge of bundle B in position P2 preparatory to tumbling to the position P3 |
| Rect.Blk.14 | Magnetic Proximity Switch | Detects full retraction of pusher 601 |
| Rect.Blk.15 | Magnetic Proximity Switch | Detects full retraction of upset arms 505 |
| Rect.Blk.16 | Strip Switch | Detects presence of bundle B in position P3 against the inclined support 501 |
| Rect.Blk.18 | Photocell | Detects interim position of pusher 601 just beyond the squaring side plate 502-1 |
| Rect.Blk.19 | Microswitch | Detects fully extended position of pusher 601 after the bundle B has been pushed into the receiving unit at the output end of the outfeed platform 600 |
| Rect.Blk.20 | Photocell | Detects presence of bundle B in the output unit |
| Rect.Blk.21 | Microswitch | Detects position of maximum elevation for the lift 200 opposite the backstop 302 |
| Rect.Blk.22 | Magnetic Proximity Switch | Detects full retraction of squaring side panels 502-1 (and 502-2) |
| Rect.Blk.23 | Microswitch | Detects contact of separator plate 402 against back edge of the bundle B |
| Rect.Blk.24 | Photocell | Detects presence of stack S on lift 200 in the vacinity of the fixed backstop 301 |
| Rect.Blk.25 | Strip Switch | Safety load detector to assure that the stack S has not become skewed to a position where collapse can occur |

The system 10 may be operated manually or automatically. In manual operation appropriate controls are activated as the various sensors, in the numbered rectangular blocks of FIG. 3 become energized. In automatic operation the sensor signals initiate and produce a continuing set of operations.

Figure 4A:
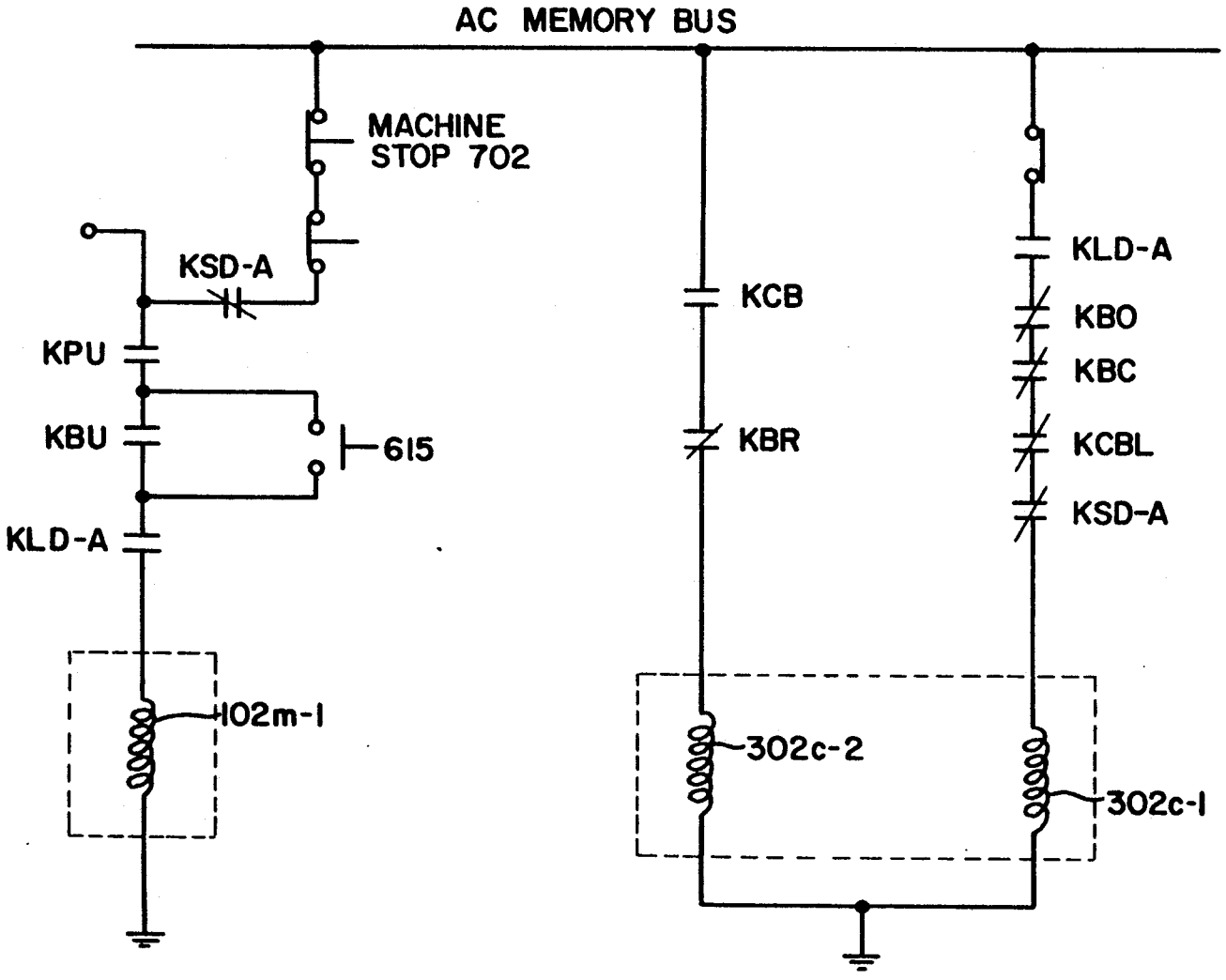
FIG. 4A is a schematic diagram of a portion of the control circuitry for automatic operation of the in-feed conveyor, and for automatic operation of the movable backstop used in the invention.

The control circuitry for automatic operation of the infeed conveyor 100 and the movable backstop 302 is shown in FIG. 4A. In general the system 10 is illustratively operated from a standard alternating current power source which is in turn used in the manual operation of various drive motors, including the drive motor (not shown) for the infeed conveyor 100 and a similar motor (not shown) for the movable backstop 302. In addition, as discussed below, the system is operated by various relays which are desirably energized by direct current signals, derived from the alternating current input by standard rectification.

In effect, the system includes two bus bars, one for alternating currents and a second one for direct currents. These are supplemented by two additional bus bars for respective alternating current and direct current control when the system is under automatic operation.

Turning specifically to FIG. 4A and the control circuitry for the infeed conveyor 100 and the movable backstop 302, in automatic operation from the alternating current memory bus, through a machine stop switch corresponding, for example, to the switch 702 of FIG. 1 operation of the stop switch allows the automatic sequencing of the system 10 to be interrupted as desired by the operator. With the stop switch 702 in its closed position, an alternating current signal, for example at standard power line voltage, is applied to the motor coil **102*m*-1 for forward operation of the conveyor through a set of contacts Each of the contacts is associated with the relay and is indicated by two parallel lines for contacts which are normally open, but are closed when the associated relay is energized. Conversely, for contacts which are normally closed but which are opened when the associated relay is energized, the parallel lines of the contact are joined by a diagonal segment. In the control branch for the infeed conveyor 100 the normally closed contacts are designated KSD-A, while the first set of normally opened contacts is designated KPU. In each case the K designation refers to contacts. In the first designations KSD-A, the initials SD refer to "stack detection" at rectangular block 24 in FIG. 3. The suffix "A" refers to the fact that in the particular implementation that has been employed there are two stack detection relays, respectiviely designated "A" and "B", with the first such relay being operated in the control branch for the infeed conveyor 100. The next set of contacts in the control path, designated KPU, indicates that there is an open circuit in the branch until the separator 400 (FIG. 3) has been pivoted to its fully upward position. The next set of contacts, designated KBO, indicates there is an open circuit until the movable backstop 302 has been fully extended to the position shown in FIG. 3. The designation "KBO" can be read as contacts "backstop out". The final set of contacts in the control branch for the infeed conveyor is designated KLD-A. This designation refers to the "A" relay that is energized when the "lift" 200 is "down" as a result of a signal from the detector at rectangular block 2 of FIG. 3**.

In the particular embodiment of FIG. 4A provision is made to bypass the contacts KBO (for the backstop fully out) by a manually operatable shunt switch 615 which is illustratively mounted in the cluster 610 of control switches on the outfeed platform 600. This allows infeed of the stack whether or not the backstop 302 is fully extended to the position shown in FIG. 3 at the option of the operator.

In regular automatic operation in-feed takes place if there is no prior stack on the conveyor, i.e., the detector of rectangular block 24 has not been operated and the relay associated with the leading edge detector has not opened the contacts KSD-A. In addition, the separator pivot must be fully up, i.e. contacts KPU are closed. This is to assure that the incoming stack will not inadvertently engage the lower portion of the separator 400 in FIG. 3. The movable backstop 302 must been fully extended, by virtue of closure of contacts KBO. This provides a suitable spacing of the incoming stacks from the backstop when the stack is higher than the level of the fixed backstop. As noted above, this effect can be manually overridden by the operator using switch 615. Finally, the lift must be down causing closure of the contacts KLD-A. The stack S in FIG. 1 then moves forwardly until it operates the detector of rectangular block 24 in FIG. 3 and opens contacts KSD-A. The stack is then positioned for the next step in the automatic sequencing.

Before considering the automatic raising of the lift to permit peel-off of a bundle corresponding to the bundle B1 in FIG. 3, the automatic operating of the movable backstop 302 will be discussed in connection with the control branches which include the contactor coils **302*c*-1 and 302*c*-2 for the respective forward and reverse operations of the backstop motor (not shown). The branch for reverse operation which includes the contactor coil 302*c*-2 has relay contacts KCB (normally open) and KBR (normally closed). The contacts KCB which operate when the stack is close to the movable backstop at the position of the detector designated by rectangular block 4, are sufficient to retract the backstop 302 until it reaches the position of the detector in rectangular block 5, at which time the contacts KBR are opened at the position of "backstop retracted". The companion path for forward automatic motion of the backstop 302 including the forwarding contactor coil 302*c*-1 includes four normally closed contacts KBO, KCB, KCBL and KSD-A. A fifth set of contacts KLD-A are normally open. The contacts KCB, KCBL and KSD-A are closed unless there is a stack "close to backstop" or there is a "stack detected" so that when the lift is fully down, and KLD-A is operated, the backstop will be moved fully forward to the postion shown in FIG. 3 until the detector at rectangular block 3** operates and energizes the relay associated with the contacts KBO to open the forward control branch.

Thus, with the lift down and no stack on the lift the backstop 302 will be fully extended and remain so until there is a stack on the lift which activates the detector of rectangular block 4. The movable backstop therefore assures that a tall incoming stack will be appropriately displaced from the fixed backstop and simultaneously is programmed to avoid interference with the subsequent lifting of a comparatively short stack which is initally below the level of the movable backstop.

Figure 4B:
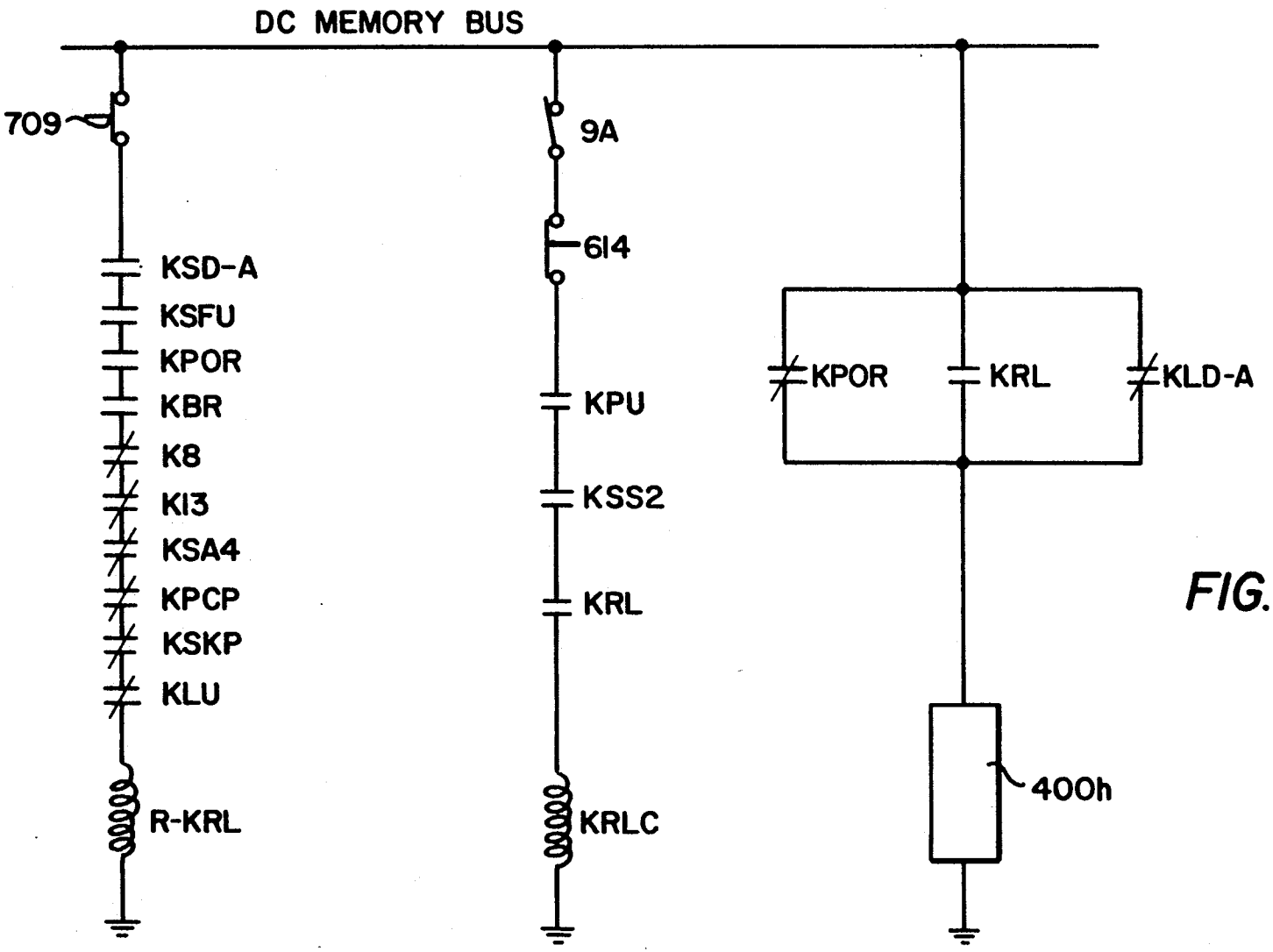
FIG. 4B is a schematic diagram of a portion of the circuitry employed for automatic lifting and positioning of the peel-off mechanism in accordance with the invention.

The control branches associated with the automatic raising of the lift and the peel-off of the top portion of the stack to form the bundle B1 is shown in FIG. 4B. The first control branch in FIG. 4B which includes the relay R-KRL, i.e, the relay for the contacts that will "raise the lift" includes four normally open contacts KSD-A, KSFU, KPOR, and KBR; and six normally closed contacts K8, K13, KSA4, KPCP, KSKP, and KLU. As a result the lift will raise automatically as long as there is a stack on the lift so that the dectector at rectangular block 24 is operated, closing the contacts KSD-A (leading edge of the stack detected), the front stop 303 of FIG. 3 is fully up and has operated the detector at rectangular block 8 which in turn closes the contacts KSFU (stop fully up). In addition, the peel-off finger 402 must be fully retracted and the detector at rectangular block 7 activated to close contacts KPOR (peel-off retracted). Finally, the backstop 302 must also be fully retracted, as discussed above to prevent interference with the rising stack. The normally closed contacts will remain in that condition as long as the system 10 is not cycling, which would operate and open contacts K8, and there is no bundle on the conveyor 304 at the position of detector 13 which would operate contacts K13 and KSA4. The stack continues to rise until it reaches the peel-off position at rectangular detection block 9 operating and opening contacts KPCP (peel control position) and KSKP (stack position). The other control on raising the stack is that the lift has not reached its maximum elevation position at rectangular block 21 causing opening of the contacts KLU (lift up).

When the foregoing conditions are satisfied, the relay R-KRL operates contacts KRL in the second control branch containing the contactor coil KRLC for the hydraulic lift motor (not shown). Other contacts in the control branch for the hydraulic lift motor include normally closed contacts KPU and normally open contacts KSS2. As a result the lift will operate only as long as the separator 400 is in contact with a strip switch and the separator pivot is not fully up. When the separator pivot is fully up, the contacts KPU (pivot up) open and the movement of the separator from the strip switch produces an open circuit which terminates any further operation.

The relay R-KRL also acts in the control branch that lowers the separator assembly. This branch controls cylinder **400*h* in FIG. 3 by three parallel contacts of which two are normally closed and one is normally open. The normally open contacts KRL thus act on the cylinder 402-h while the lift is being raised. The parallel contacts KLD-A also provide a signal path when the lift is not fully down and the further shunt contacts KPOR provide a further signal path when the peel-off finger 402** is not fully retracted, i.e. there is no operation as a result of "peel-off retraction".

The next automatic operations involve the front stop 303, the separator plate 401 and the peel-off finger 402. As noted in conjunction with the raising of the lift, one of the conditions was that the front stop be fully up in order to close the contacts KSFU as a result of the detector at rectangular block 8. In order to exercise proper peel-off operation the front stop must be down to the position shown in FIG. 2. This action is accomplished by the hydraulic cylinder **303*h* in the first control branch of FIG. 4C. This branch contains normally open contacts KSKP (stack in peel-off position) and KBCT (bundle conveyor timing). Also included are normally closed contacts KPU (pivot up) and K13 (bundle at dectector 13). As a result the front stop will be lowered if the stack is in peel-off position (through the operation of contacts KSKP, resulting from the signal detected at rectangular block 9). The associated contacts KBCT will also be closed after a suitable delay interval to assure that there is no bundle on the conveyor 304 which would interfere with the lowering of the stop 303. The remaining contacts KPU and K13 will remain closed as long as the separator 400 is not fully up and there is no detected bundle at detector position 13**.

Figure 4C:
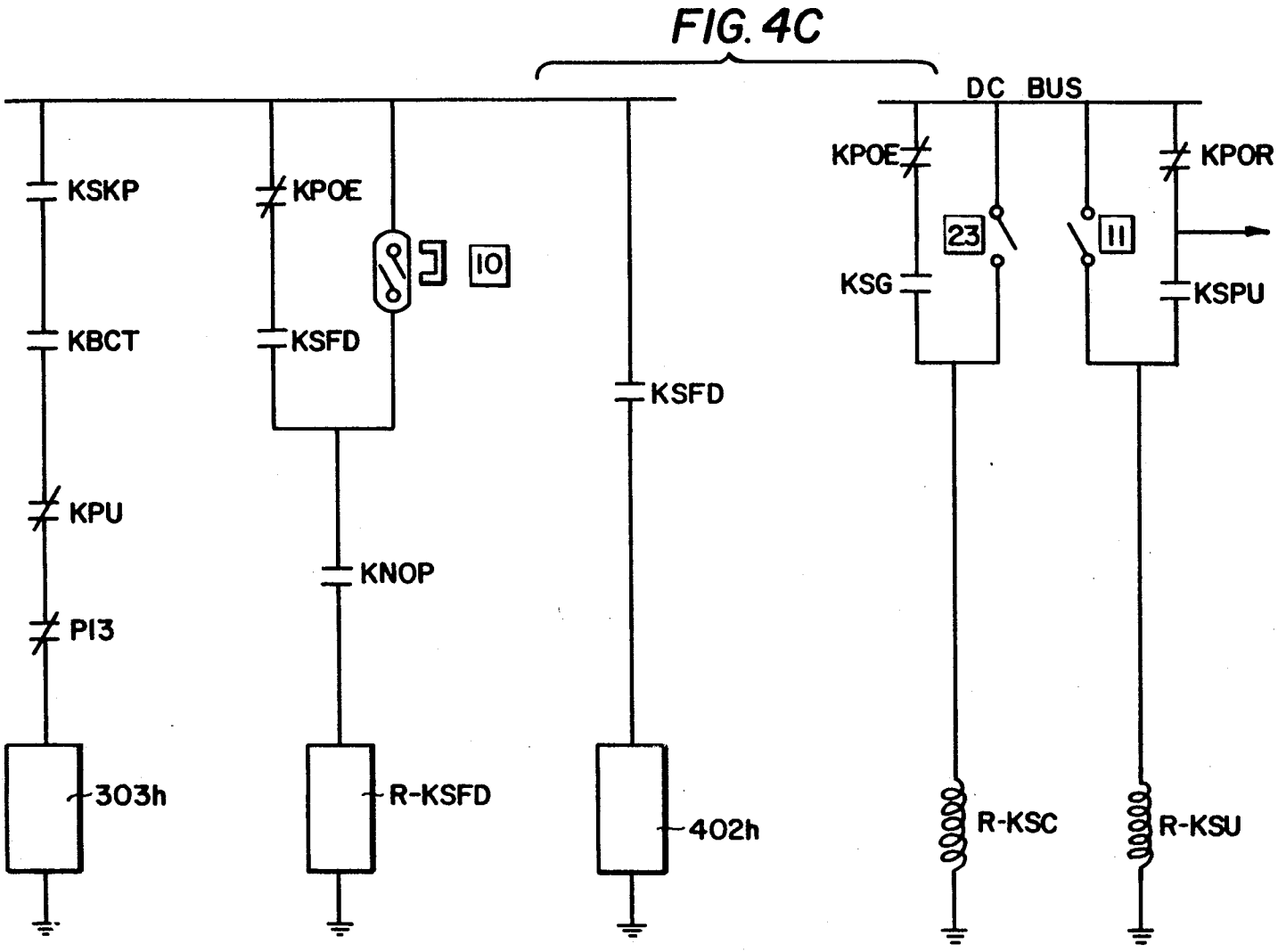
FIG. 4C is a schematic diagram of illustrative circuitry for operating a front stop and a separator.

With the stop 303 fully down this condition is detected at rectangular block 10 and activates relay R-KSFD in the second control branch as long as the contacts KNOP (peel-off "not partially" retracted by operation of the detector at rectangular block 7A) remain closed. The relay R-KSFD (stop fully down) is held operational by the shunt branch for the detector of block 10 which includes contacts KSFD and normally closed contacts KPOE (peel-off extended). When the peel-off does become extended the stop front down signal is terminated. During the generation of the front stop down signal the third branch of FIG. 4C is operated by closure of the contacts KSFD which acts directly on the peel-off hydraulic cylinder **402*h*. The hydraulic cylinder causes the peel-off finger 402 to engage the bundle B1 of FIG. 3 at postion P1 and move it forwardly onto the bundle conveyor 304 against the backstop 303. Previously the separator plate 401 had been extended upwardly by virtue of its prior contact with the detector in rectangular block 23 as indicated in the fourth control branch of FIG. 4C. Momentary contact is sufficient to continue the signal by the relay R-KSC because the shunt branch which contains, in addition to the contacts KSG, normally closed contacts KPOE that are opened only when the peel-off cylinder 402*h* becomes fully extended. When the separator plate is fully up, it energizes the relay R-KSPU as shown in the fifth control branch of FIG. 4C**.

When the peel-off cylinder is fully extended it opens the circuit for the relay R-KSFD as well as the circuit for the relay R-KSC. When power is removed from the peel-off cylinder it begins to retract and the separator plate 401 is released. This prevents the retraction of the peel-off finger from inadvertently causing a rearward displacement of the bundle B1.

Figure 4D:
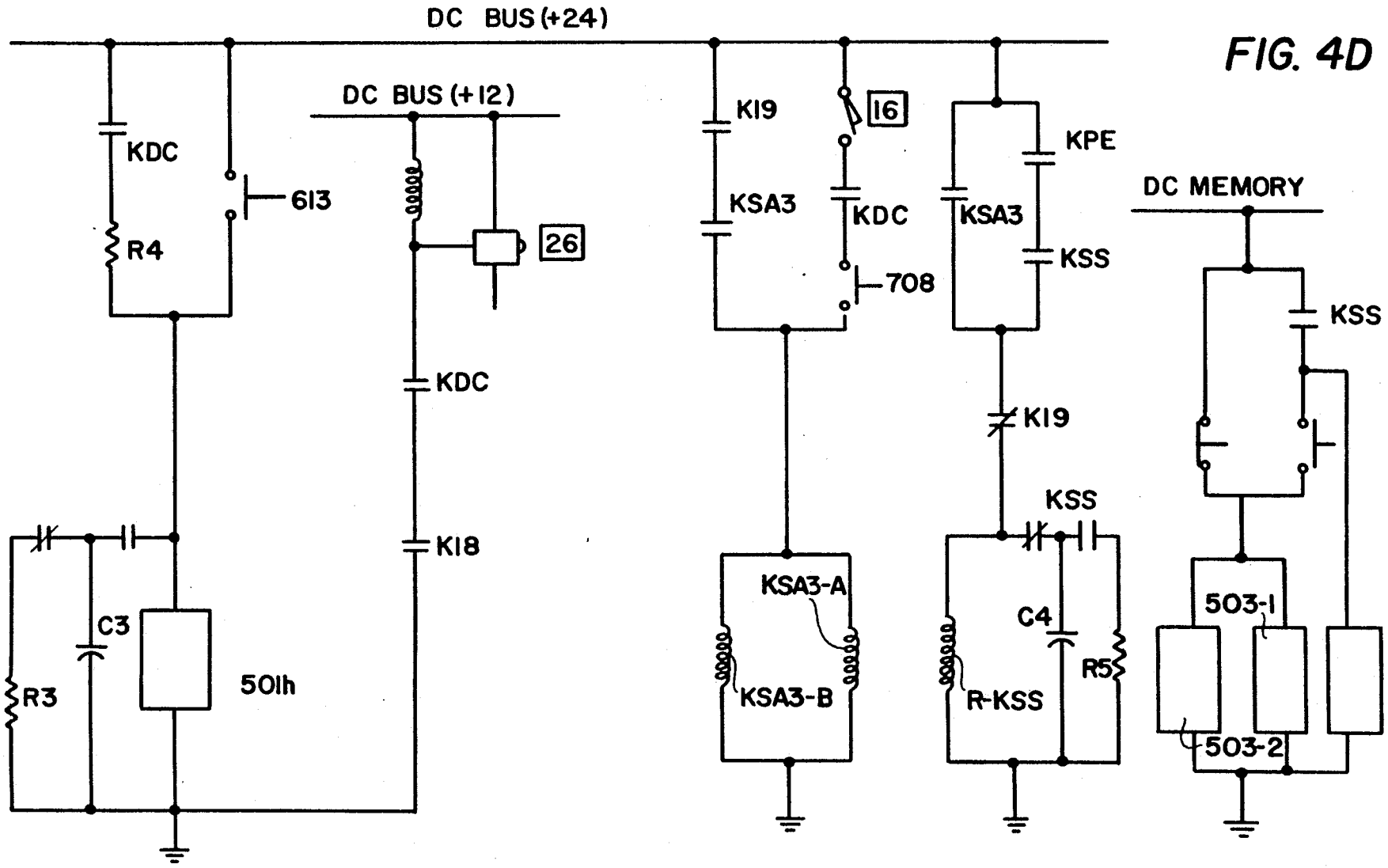
FIG. 4D is a schematic diagram of representative drop conveyor control and bundle squaring circuitry.

As previously discussed the bundle B1 moves to positon P2 until it reaches the knee K and then is loaded on the drop conveyor **501*d* or simply tumbles against the backstop 501. The control branch for the drop conveyor is the first of the branches shown in FIG. 4D. This branch acts upon the drop conveyor cylinder 501*h*. It is to be noted that the drop conveyor 501*d* may be omitted from the system 10 but when it is included it is desirably maintained at its receiving position shown in FIG. 3 above the level of the inclined support 501. When a load is detected on the drop conveyor by the operation of the photocell at detector block 26, the first two branches in FIG. 4D are active with the result that the relay R-KDC (drop conveyor) is energized from the photocell D26. This in turn closes the normally open contacts KDC in the first branch and causes the cylinder 501*h* to be lowered into alignment with the inclined backrest 501. This action is sensed by the detector D16 in rectangular block 16 and produces signals in the relays R-KS3-A and R-KS3-B in the third branch of FIG. 4D. This in turn operates the squaring cylinder relay R-KSS in the fourth branch of FIG. 4D which acts upon the side guides 502-1 and 502-2 (not visible in FIG. 3**).

Figure 4E:
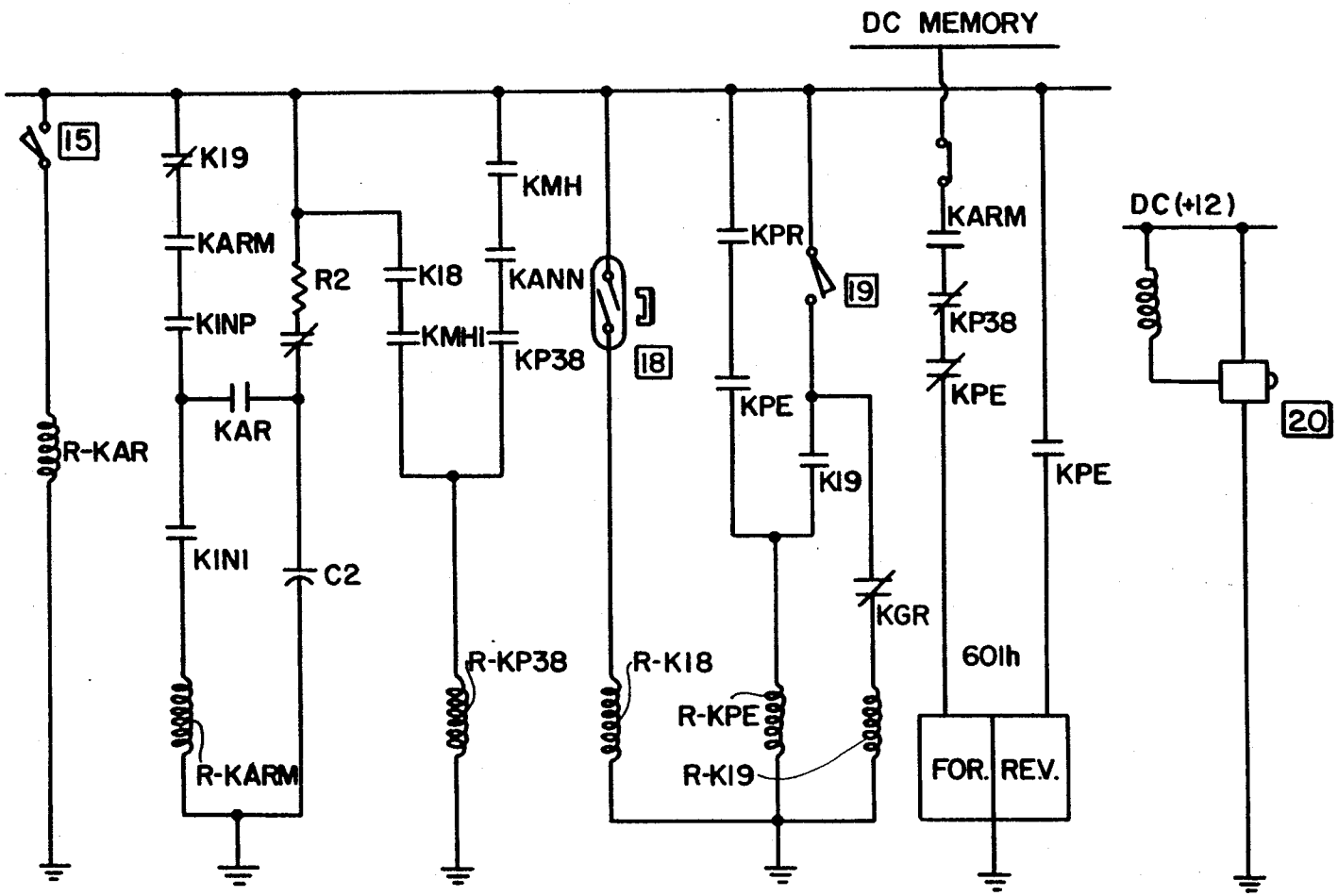
FIG. 4E is a schematic diagram of outfeed and upset circuitry for the practice of the invention.

Once the bundle B1 has been squared, it is ready for upset and subsequent pushing along the outfeed platform 600. The control circuitry for these operations is set forth in the control branches of FIG. 4E. The first branch includes a relay R-KAR (arms retracted) which is energized when the detector in rectangular block 15 is operated by switch closure. The relay R-KAR acts upon the transfer contacts KAR in the second branch, the capacitor having previously been charged and its charge applied by the transfer action of the contacts KAR to the relay R-KARM. The latter then serves to permit operation of the pusher 601-1, the upset arms having been operated following the action of the squaring cylinder in producing a delay signal on the timing branch and the extend branch shown in FIG. 4E.

The pusher cylinders are actuated in accordance with their control branch and their operation is monitored at detect 18 and 19. In addition, a detector in rectangular block 20 indicates that the bundle B1 has been pushed from position P6 beyond the end of the outfeed conveyor 600.

The operations of the various relays and contacts can be followed in greater detail with reference to the following tabulation of the contacts and their functions. It will be appreciated that in each instance the relay associated with the contacts bears the same designation as the contacts with the prefix "R".

| CONTACT DESIGNATION | FUNCTION |
|---|---|
| KCBL and KCB | Operate when the stack is close to the backstop (movable) as monitored at the detector in rectangular block 4 |
| KSKP & KPCP | Operate when the stack is in position for the peel-off of bundle B1 as monitored by the detector in rectangular block 9 |
| KBR | Operates when the movable backstop 302 is fully retracted as detected by the switch in rectangular block 5 |
| KBO | Operates when the movable backstop is fully out or extended as detected by the switch in rectangular block 3 |
| KSD-A & KSD-B | Designates A and B relay contacts which operate when the stack is detected near the fixed backstop 301 at the position of rectangular block 24 |
| KLD-A & KLD-B | Refers to A and B relays which operate when the lift 200 is fully down as detected by a switch at rectangular block 2 |
| KPU | Detects fully elevated position of the separator 400 at detector in rectangular block 6 |
| KRL | Provides a signal for the raising of the lift 200 |
| KPOR | Indicates that the peel-off cylinder 402h is fully retracted |
| KSFU | Indicates that the front stop 303 is fully elevated as detected by the magnetic proximity switch in rectangular block 8 |
| KSFD | Indicates that the front stop 303 is fully down as indicated by the magnetic proximity switch in rectangular block 10 |
| KSC | Indicates contact of the separator plate 401 with the detector switch in rectangular block 23 |
| KPOE | Indicates that the peel-off cylinder 402h is fully extended as detected by the magnetic proximity switch in rectangular block 12 |
| KSPU | Indicates that the separator plate 401 is fully elevated as indicated by closure of the switch in rectangular block 11 |
| KNOP | Indicates when the peel-off finger 402 is partially retracted by operation of the magnetic proximity switch at rectangular block 7A |
| KINI | Provides an initializing operation that allows direct current energy to be applied to the system before alternating current energy |
| KPCP | Indicates when the stack is in position for having the bundle B1 separated by the separator 400 as a result of photocell operation at rectangular block 9 |
| KSS2 | Indicates when the strip switch associated with the separator 400 has been operated |
| KRLC | Contactor for the hydraulic motor associated with the lift 200 |
| KBC | Contactor for the motor associated with the bundle conveyor 304 |
| KUAC | Designates upset arms cylinder |
| KUAT | Designates upset arms pulse interval timer |
| KSST | Designates delayed signal produced by operation of the squaring cylinder 503-1 |
| KSS | Control signal for operating squaring cylinder |
| K13 & KSA4 | Responds to trailing edge of bundle at the photocell detector in rectangular block 13. These contacts and relays operate in conjunction with intermediate contacts K13P |
| KBCP | This produces a delayed timing signal for the bundle conveyor 304. |
| KSA3-A & KSA3-B | Respond to the presence of the bundle B1 against the inclined backstop as detected by the closure of switch D16 |
| KGR | Indicates that the squaring side guides 502-1 and 502-2 are fully retracted, i.e. spread apart |
| KUAR | Indicates when the upset arms 505 are fully retracted by closure of the switch at rectangular block 15 |
| KPR | Indicates when the pusher 601-1 is fully retracted by the operation of a magnetic proximity switch at rectangular block 14 |
| KSGT | A delay timer for scrap gate associated with scrap conveyor 80 of FIG. 1 |
| KPE | Operates when the pusher 601 is fully extended. In addition, signals are generated at positions 18 and 19 designated K18 and K19 for rectangular blocks 18 and 19 respectively. These produce a further signal at a 38" interim point designated KP38. |
| KAR-N | Indicates a position of the upset arm 505 |
| KLU | Indicates that the lift 200 is fully elevated |
| K8 | Indicates reset for a new load |
| KPC | Indicates completion of a cycle of operation |
| KMH1 | Indicates that the hopper at the output end of the outfeed conveyor 600 has received material |
| KDC | Indicates operation of the photohead at position 26 for the drop conveyor 501d |
| KINP | Indicates activation of a strip switch on the inclined support 501 |
| KJRT | Provides a reverse movement timing interval for the frame 300 |
| KJFT | Provides a forward timing interval for the frame 300 |

Figure 5A:
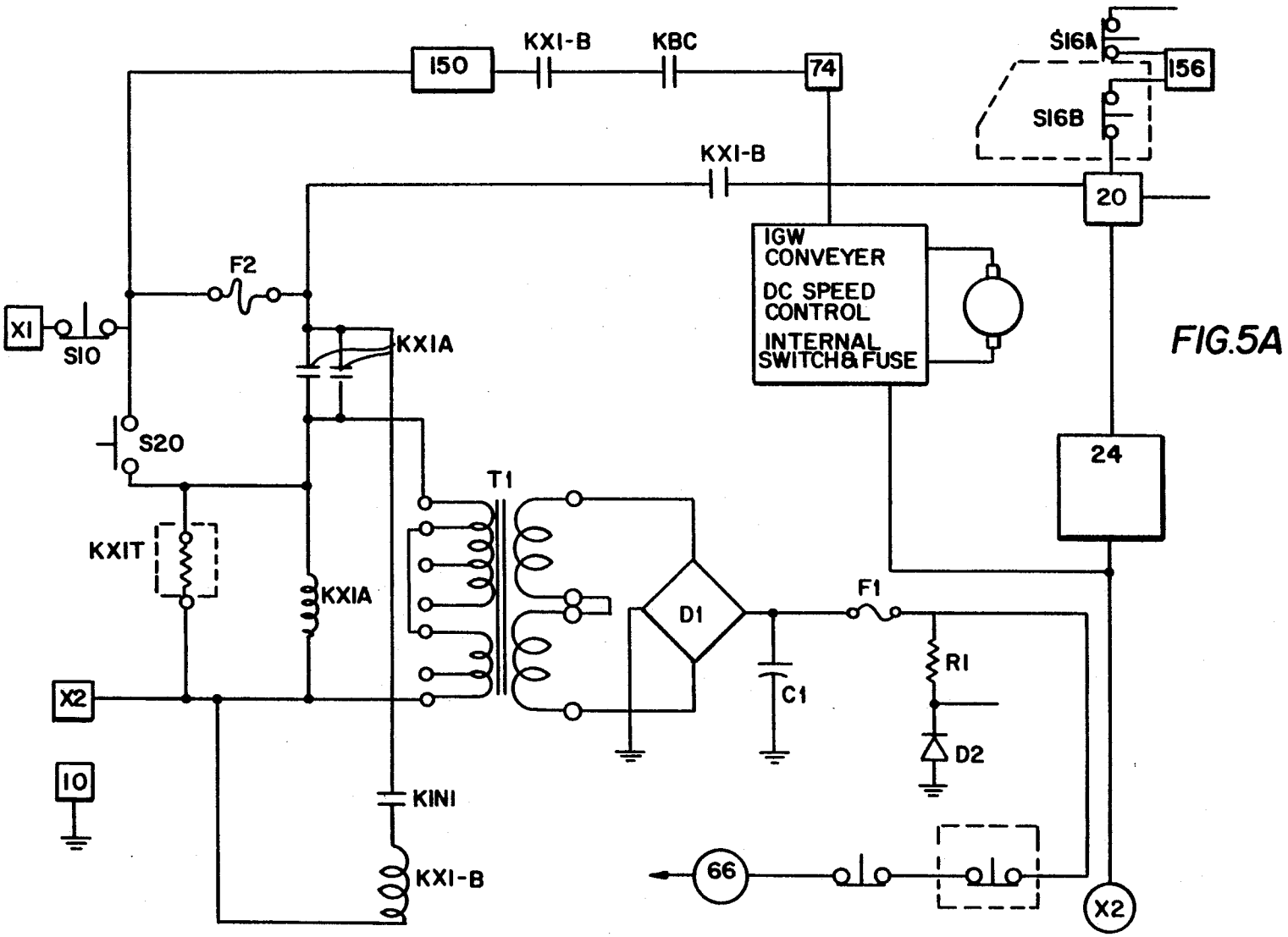
FIG. 5A is a schematic diagram of power supply circuitry and associated stack feed and bundle conveyor circuitry.
Figure 5B:
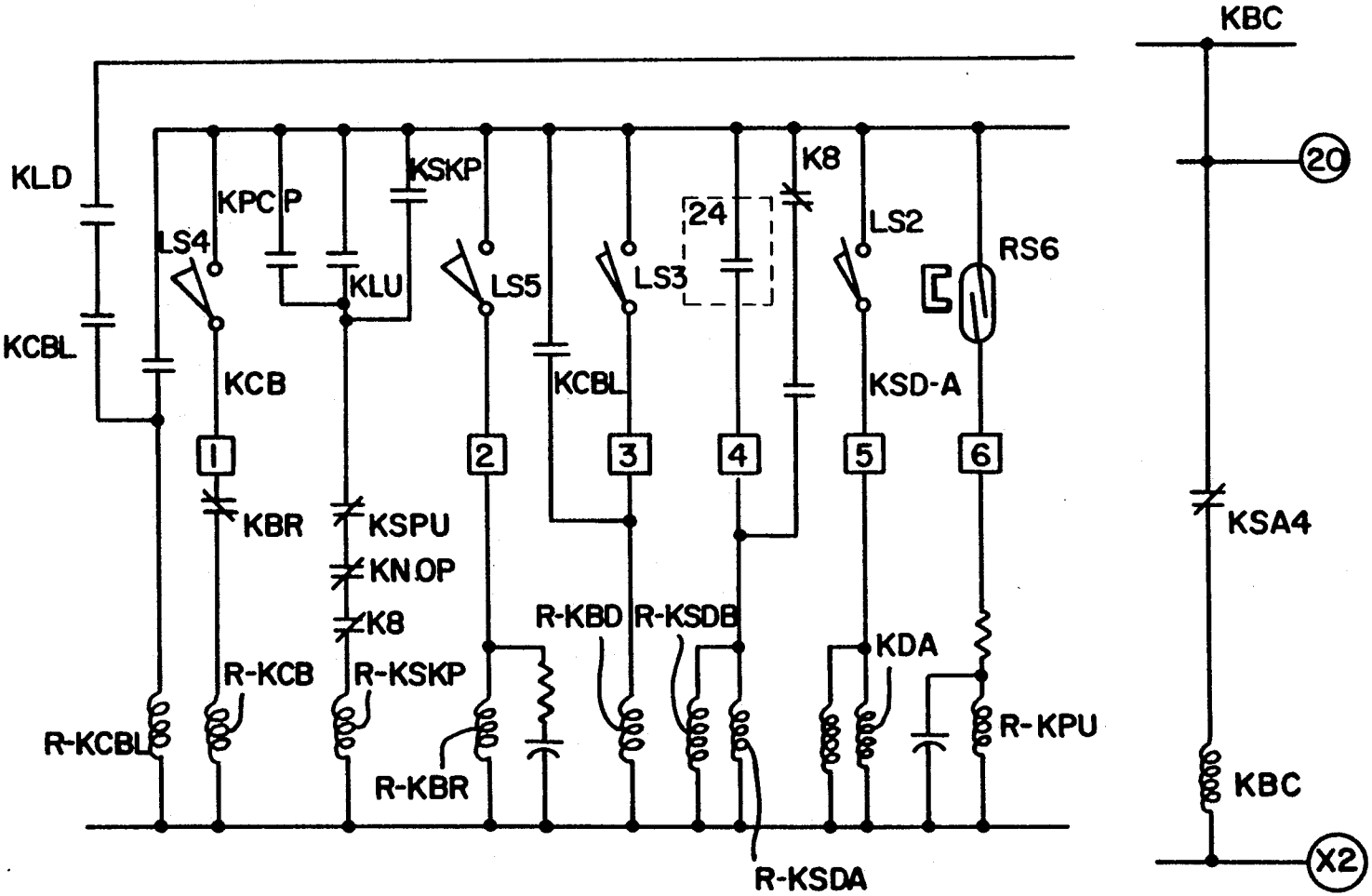
FIG. 5B is a circuit diagram of additional circuitry for stack detection, lift operation and accessory operation.
Figure 5C:
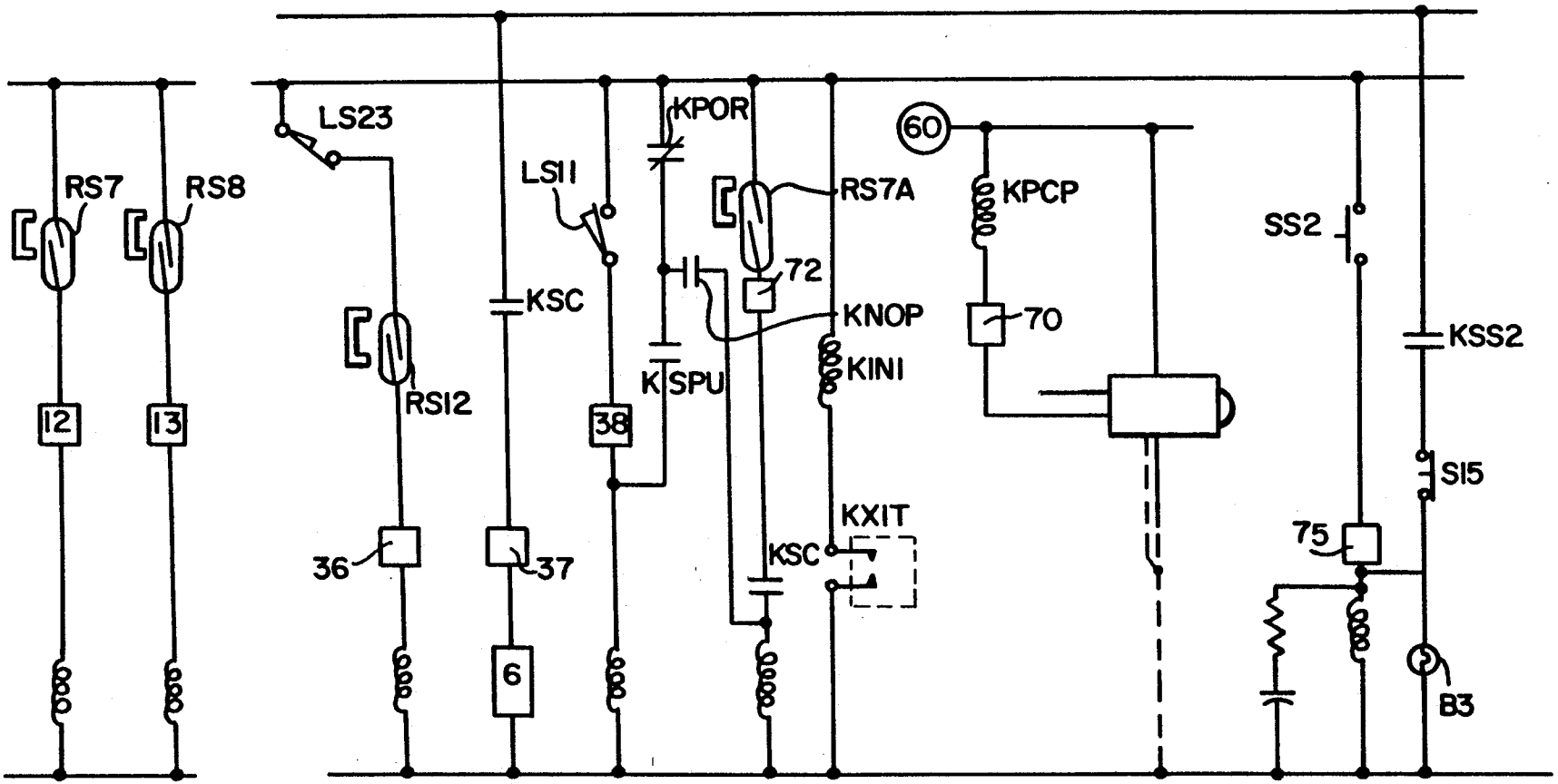
FIG. 5C is a schematic diagram for separator plate, peeler and other accessory operation.
Figure 5D:
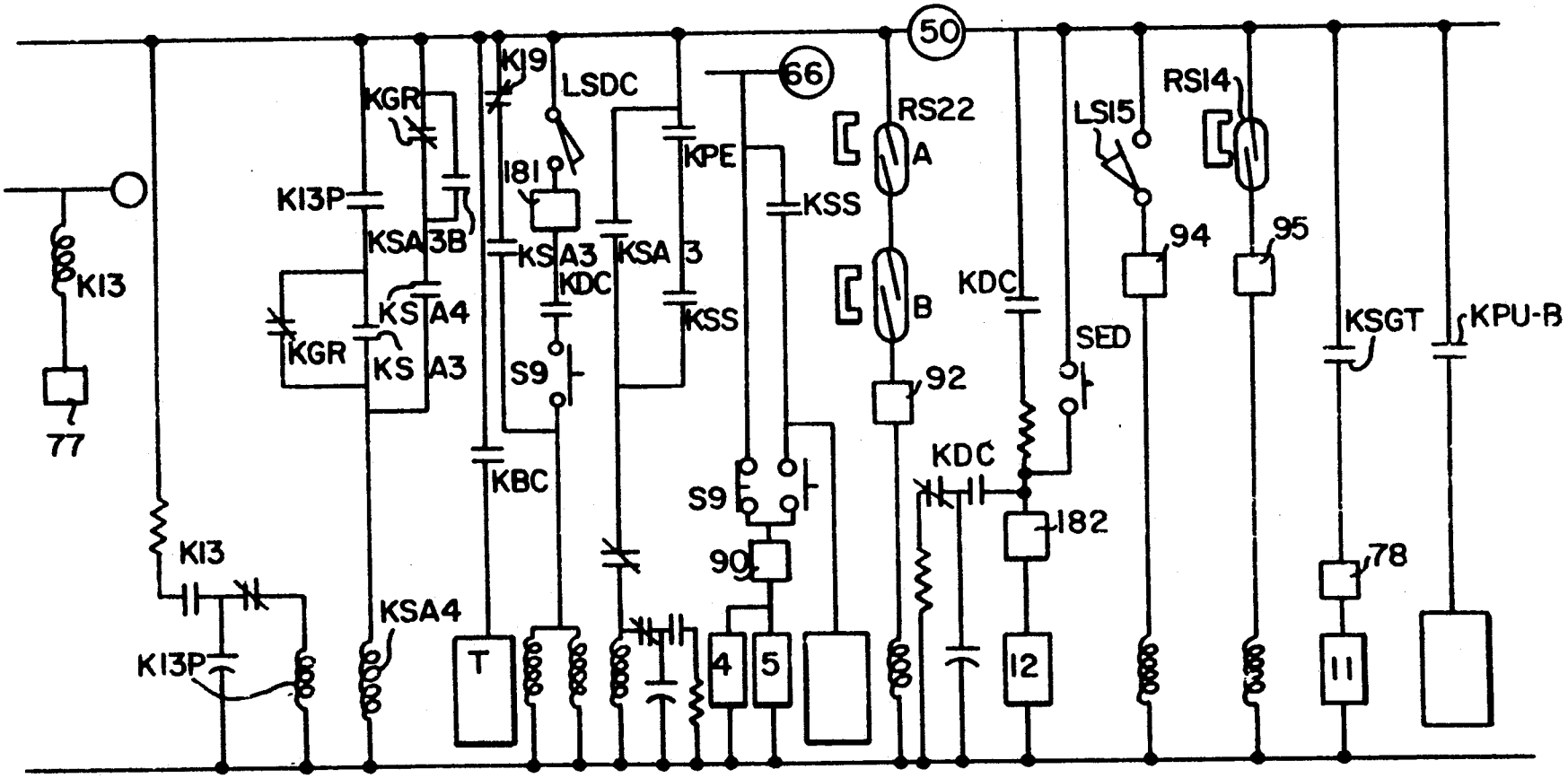
FIG. 5D is a circuit diagram for bundle conveyor, squarer and pusher circuitry.
Figure 5E:
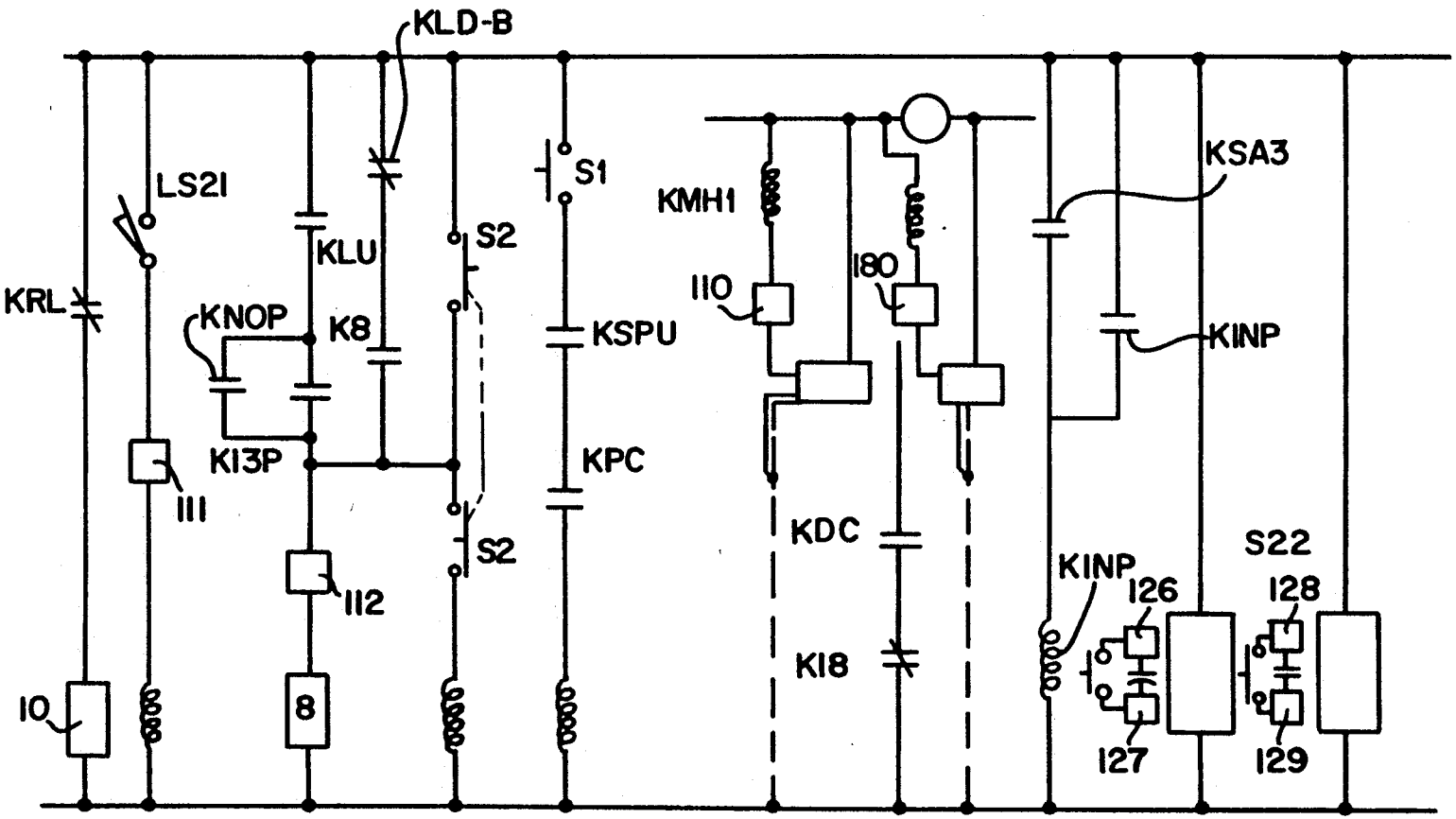
FIG. 5E is schematic diagram of lift reset, initialization and related circuitry.
Figure 5F:
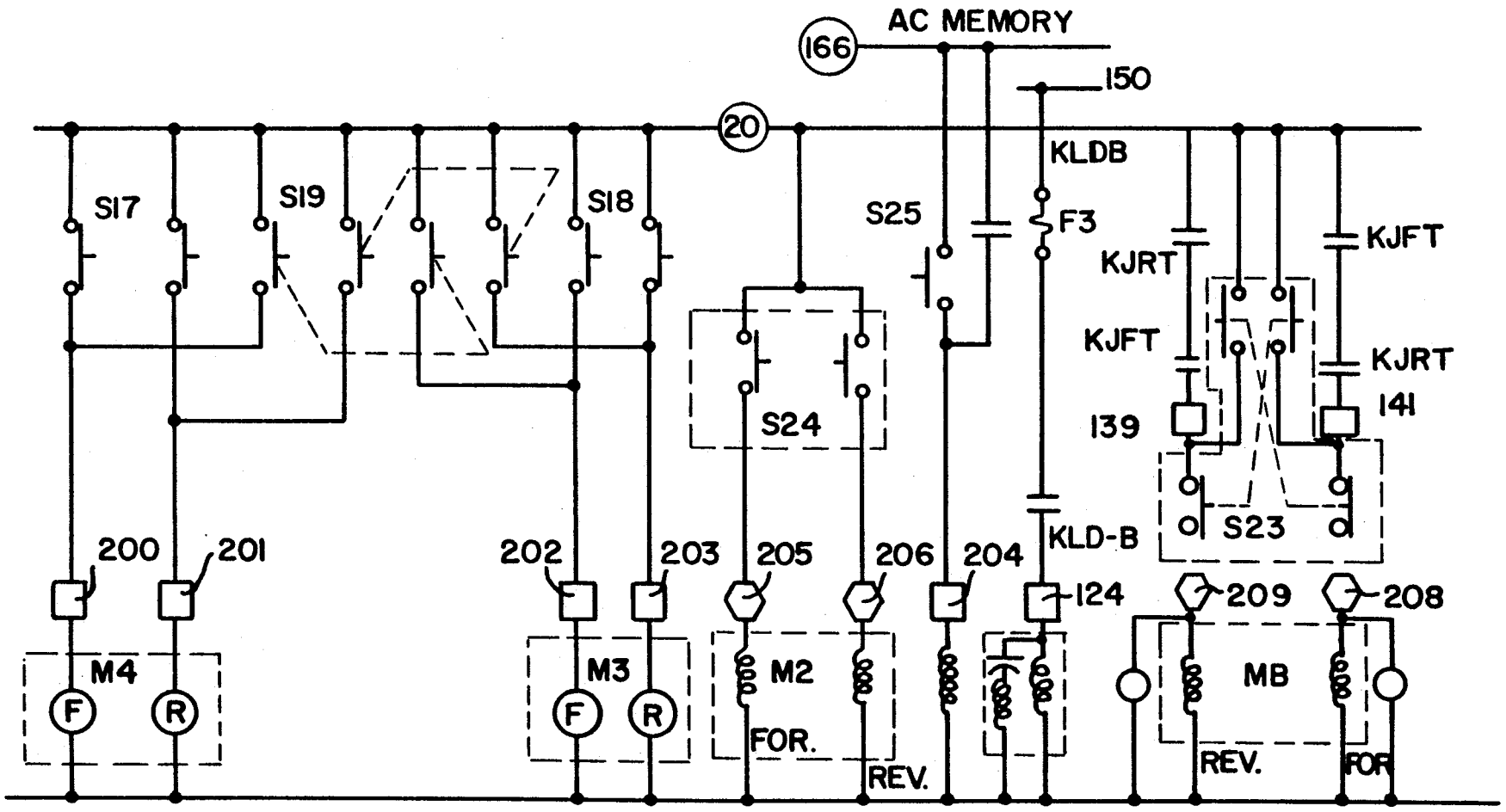
FIG. 5F is a circuit diagram of guide separator, scrap conveyance and walk circuitry.

Representative circuitry for providing alternating current and direct current energization of the system 10 is illustrated in FIG. 5A. Similarly, additional circuitry for accomplishing other functions not previously discussed, making use of the various contacts enumerated above is set forth in FIG. 5B.

The upset arms 505 for the system 10 of FIG. 3 provide stack upset retaining the same orientation of the upset sheets as existed for the sheets originally conveyed to the lift 200. In the system 10' of FIG. 6 upset arms are provided which reverse the orientation of the bundle B1'. For that purpose the arms 505 of FIG. 3 are replaced by flip-over cylinder **506*h'*. It can be seen that the arms 506' have a pivot 506*p'* slightly above the pusher carriage 600'. The cylinder 506*h'* is connected to the arms 506' at an intermediate position 506*m'* in order to accomplish the desired flip-over the bundle B1' along the trajectory T1' from the position P4' to the new outfeed position P5'. The trajectory taken by the arms 506' is indicated by the dashed lines T2' at the tip end of the arms 506'**.

The pusher carriage 600' includes spring-loaded pusher arms 601'. By virtue of their spring-loading, the arms 601' can pivot below the bundle B1' on their return motion. Illustratively, the pusher 601' is operated by a cable cylinder 602' which in connected to the pusher 601' by a cable **602*c'***.

Figure 6:
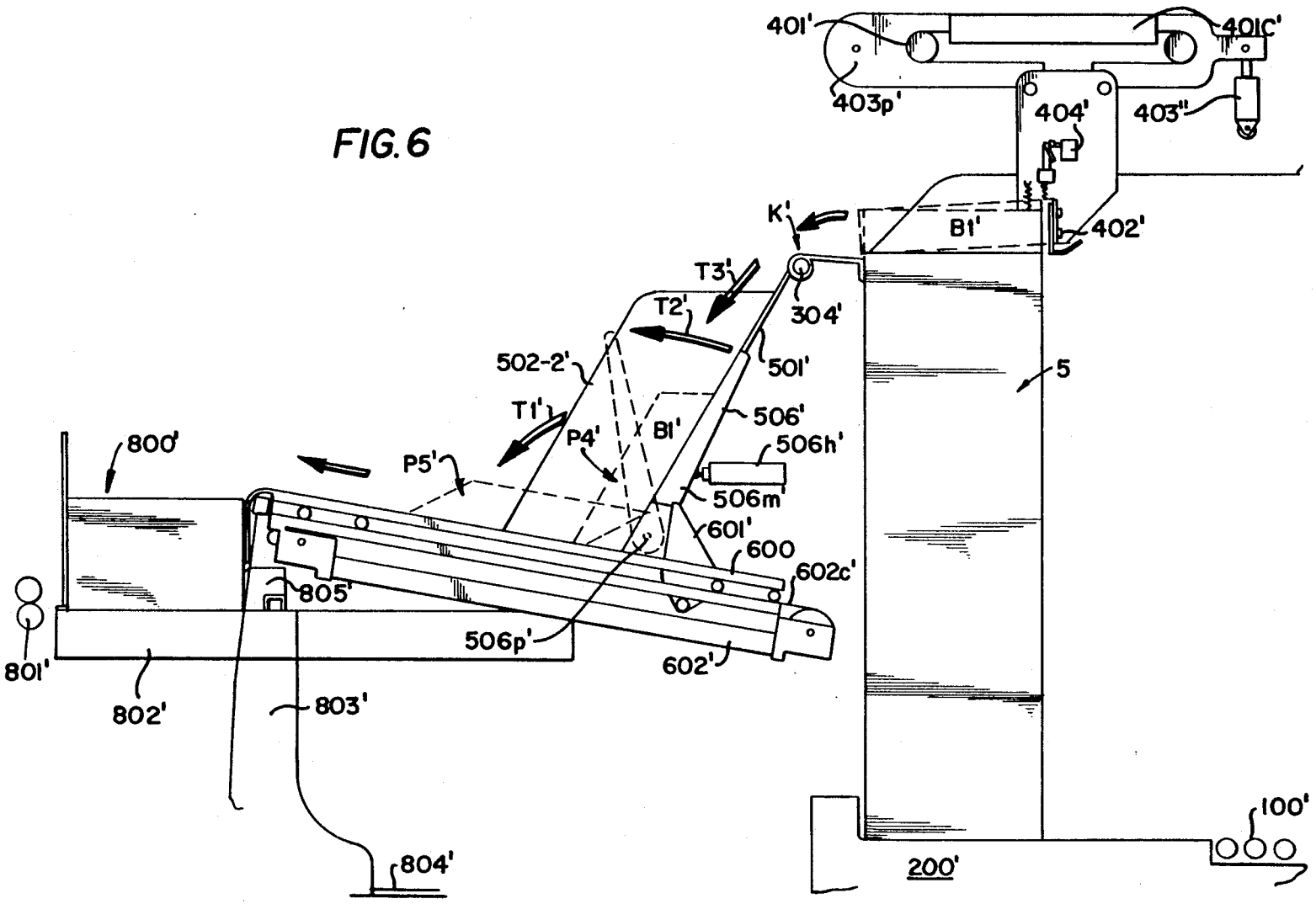
FIG. 6 is a block and schematic diagram of an alternative system for the practice of the invention.

In the embodiment of FIG. 6, an outline is shown of the hopper 800' which receives the bundle B1' and successive ones. The hopper is illustrated after having received approximately two bundles. The output of the hopper includes paper feed rolls 801' which receive individual sheets at the base of the hopper and feed them successively to a utilization device such as a printing press. The hopper is mounted on a feed table 802' which is in turn supported by a press kicker frame 803'. The latter is adjustably movable along press tracks 804'.

The feed table 802' includes a back ledge support 805' for the pusher carriage 600'.

It will be noted that by contrast with the embodiment of FIG. 3, there is no movable backstop 302, or gate 303.

In addition, the separator 400' is not pivoted like its counterpart 400 in FIG. 3 but instead is horizontally displacable with respect to a peel-off pusher carriage 401' that is operated by a cable cylinder 401*c'* in a fashion similar to that described for the pusher 601' on the carriage 600'. The separator 400' also includes a counterbalance and pivot cylinder 403' for adjusting the level of the separator with respect to a pivot point 403*p'*. The pusher carriage 401' includes a spring-loaded pusher plate 402' which acts against the stack S and picks off the desired bundle B1'.

In the case of the embodiment in FIG. 6, there is no bundle conveyor and the pusher plate 402' pushes the bundle B1 over the knee K' formed by a roller 304'.

The stack is positioned on a lift 200' which is fed by a telescoping infeed conveyor 100'.

The operation of the system 10' is similar to that previously described. A stack enters the elevator area and is positioned on the lift. For this purpose the rollers included in the lift can be depressed below the level of the telescoping conveyor 100'. The lift 200' then raises the load to the peel-off position. The height of the load in the embodiment of FIG. 6 is established by a level control microswitch 404' which interrupt the lifting action.

With the stack in position as shown in FIG. 6, the pusher plate 402' separates and lifts a bundle B1' from the stack S as shown and moves it over the roller 304' along a trajectory T3'. The bundle drops until its leading edges contact the surface of the carriage 600' and its faces are in contact with one another upon the inclined support 501'. Side plates for squaring including the plate 502-2' are used to align the side edges of the sheets in position P4'. With the side plates in squaring position, the sheets are upset by the flip-over arms 506' as previously described.

The pusher 601' is started up the ramp 600' to load the press feeder 800'. Because of the shape of the pushing front edge of the pusher 601', there is a cam effect at the end of the pushing stroke.

With the prior batch in the hopper 800', the pusher returns to the position shown in FIG. 6. If there is a subsequent bundle B1' at position P4', the pusher 601', by virtue of its spring-loading is depressed below the level of the bundle B1'.

Simultaneously with the return of the pusher 601' to its initial position, the peel-off plate 402' is also returned to its original position. Any necessary clearance for the return of the plate 402' during retraction is achieved by the upward pivoting of the separator frame 400' about the pivot point 403' by operating the pivot cylinder 403'.

What is claimed is:

1. Apparatus for transporting materials which comprises means for elevating a stack of materials;

means for transporting a group of the elevated materials from the means for elevating to a substantially planar surface that is inclined with respect to a horizontal plane;

means for pivotally lowering the incline surface to a position wherein said group of materials is upset; and means for transporting said materials from said upset position.

2. The apparatus of claim 1 wherein the materials of said group are aligned against said inclined surface.

3. The apparatus of claim 2 wherein the alignment is accomplished by plates which move along said inclined support surface.

* * * * *